US012345426B2

(12) United States Patent
Shimizu et al.

(10) Patent No.: US 12,345,426 B2
(45) Date of Patent: Jul. 1, 2025

(54) AIR CONDITIONER THAT DEFROSTS OUTDOOR HEAT EXCHANGER BASED ON REFRIGERANT RESIDUE AMOUNT OF OUTDOOR HEAT EXCHANGER

(71) Applicant: Toshiba Carrier Corporation, Kanagawa (JP)

(72) Inventors: Tomoki Shimizu, Fuji (JP); Ken Miura, Fuji (JP); Tetsuma Hamashima, Fuji (JP)

(73) Assignee: Carrier Japan Corporation, Tokyo (JP)

( * ) Notice: Subject to any disclaimer, the term of this patent is extended or adjusted under 35 U.S.C. 154(b) by 155 days.

(21) Appl. No.: 18/185,537

(22) Filed: Mar. 17, 2023

(65) Prior Publication Data

US 2023/0221027 A1 Jul. 13, 2023

Related U.S. Application Data

(63) Continuation of application No. PCT/JP2020/035357, filed on Sep. 17, 2020.

(51) Int. Cl.
*F24F 11/42* (2018.01)
*F24F 110/12* (2018.01)
*F24F 140/20* (2018.01)

(52) U.S. Cl.
CPC ..... *F24F 11/42* (2018.01); *F24F 2110/12* (2018.01); *F24F 2140/20* (2018.01)

(58) Field of Classification Search
CPC .... F24F 11/42; F24F 2110/12; F24F 2140/20; F25B 47/025; F25B 2347/02; F25B 2700/11
See application file for complete search history.

(56) References Cited

U.S. PATENT DOCUMENTS

2015/0292789 A1 10/2015 Takenaka et al.
2020/0232693 A1* 7/2020 Watanabe ..... F25B 41/385

FOREIGN PATENT DOCUMENTS

CN 104813123 A 7/2015
CN 106642405 A 5/2017
(Continued)

OTHER PUBLICATIONS

The PCT Search Report and Written Opinion mailed on Dec. 1, 2020, for PCT Application No. PCT/JP2020/035357, 14 Pages.
(Continued)

*Primary Examiner* — Jonathan Bradford
(74) *Attorney, Agent, or Firm* — Lee & Hayes, P.C.

(57) ABSTRACT

An air conditioner includes an indoor unit, an outdoor unit, and a controller. The controller of an air conditioner switches between a first defrosting drive to defrost a first outdoor heat exchanger and a second outdoor heat exchanger at the same time, and a second defrosting drive to defrost the first outdoor heat exchanger after the start of defrosting of the second outdoor heat exchanger; estimates a refrigerant residue amount of the first outdoor heat exchanger and a refrigerant residue amount of the second outdoor heat exchanger; and adjusts an opening degree of the first expansion valve and an opening degree of the second expansion valve, based on the refrigerant residue amount of the first outdoor heat exchanger and the refrigerant residue amount of the second outdoor heat exchanger.

3 Claims, 8 Drawing Sheets

(56) References Cited

FOREIGN PATENT DOCUMENTS

| | | | |
|---|---|---|---|
| CN | 107642929 | A | 1/2018 |
| JP | 2009085484 | A | 4/2009 |
| JP | 2010203673 | A | 9/2010 |
| JP | 2014190641 | A | 10/2014 |
| JP | 2018035981 | A | 3/2018 |
| KR | 1020190068023 | A | 6/2019 |
| WO | WO2014083867 | A1 | 6/2014 |

OTHER PUBLICATIONS

Chinese Office Action for CN Application No. 202080105135.8, Jan. 5, 2025, 10 pages.

* cited by examiner

AIR CONDITIONER THAT DEFROSTS OUTDOOR HEAT EXCHANGER BASED ON REFRIGERANT RESIDUE AMOUNT OF OUTDOOR HEAT EXCHANGER

CROSS-REFERENCE TO RELATED APPLICATIONS

This application is a Continuation Application of PCT Application No. PCT/JP2020/035357, filed Sep. 17, 2020, the entire contents of which are incorporated herein by reference.

FIELD

Embodiments described herein relate generally to an air conditioner.

BACKGROUND

For air conditioner with two outdoor heat exchangers, there is a known technique of a defrosting control in a heating operation in which the two outdoor heat exchangers are defrosted at the same time.

In the aforementioned technique, when an outside air temperature is very low, a part of an outdoor unit where is relatively easy to be cold, for example, drain water residue in the lower part of the outdoor unit may be frozen. In such a case, if the heating drive is continued for a long time, the freezing of drain water progresses, and the freezing is nor solved even after a defrosting drive. Furthermore, the residual ice may prevent discharge of drain water newly produced, and a drain water residue amount in a frost receiver (bottom plate) increases, and accordingly, more drain water tends to freeze, which is a vicious cycle.

DETAILED DESCRIPTION

In general, according to one embodiment, an air conditioner includes an indoor unit, an outdoor unit, and a controller. The air conditioner is conditioned a temperature of a space where the indoor unit is disposed. The indoor unit and the outdoor unit are connected by a pipe. The controller is configured to control the indoor unit and the outdoor unit. The outdoor unit includes a first outdoor heat exchanger configured to exchange heat of a temperature of a medium flowing from the pipe with an outside air, and a second outdoor heat exchanger configured to exchange heat of the temperature of the medium flowing from the pipe with the outside air, the second outdoor heat exchanger disposed below the first outdoor heat exchanger. The controller includes a first defrost means and a second defrost means. The first defrost means is configured to defrost the first outdoor heat exchanger and the second outdoor heat exchanger at the same time. The second defrost means is configured to start defrosting of the second outdoor heat exchanger in advance, and to perform defrosting of the first outdoor heat exchanger after the start of defrosting of the second outdoor heat exchanger.

First Embodiment

Figure 1:
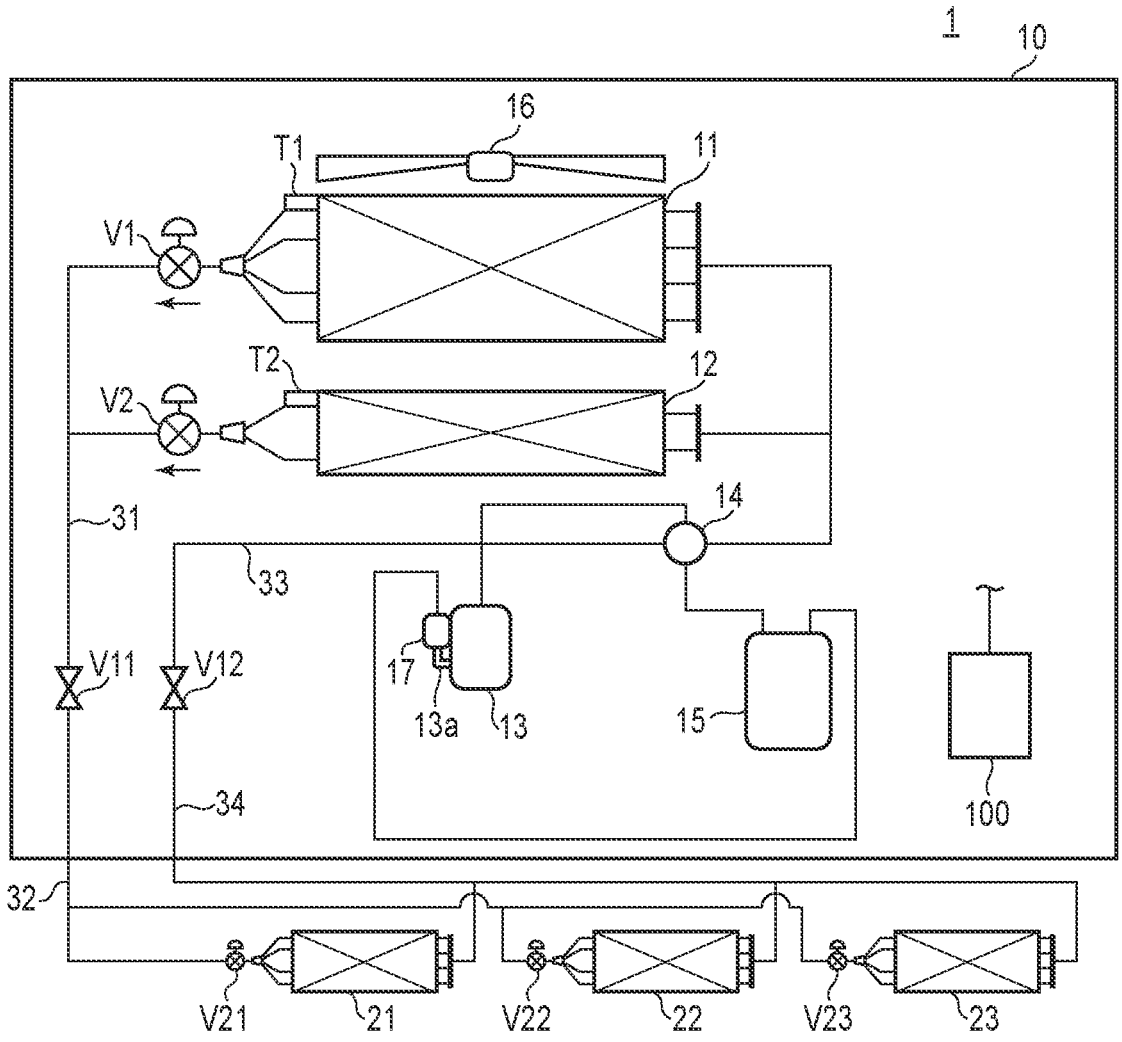
FIG. 1 is a diagram illustrating an example of the structure of an air conditioner.

FIG. 1 is a diagram illustrating an example of the structure of an air conditioner 1.

As in FIG. 1, the air conditioner 1 includes an outdoor unit 10 with an outdoor heat exchanger (first outdoor heat exchanger) 11, outdoor heat exchanger (second outdoor heat exchanger) 12, which is disposed in the lower side of the outdoor heat exchanger 11 and has a heat exchanging performance which is lower than the outdoor heat exchanger 11, compressor 13, four-way valve 14, and accumulator 15, a plurality of indoor units 21, 22, and 23, pipes 31, 32, 33, and 34 connecting between the outdoor unit 10 and the indoor units 21, 22, and 23, and a controller configured to control the outdoor unit 10 and the indoor units 21, 22, and 23. The controller 100 is provided with the outdoor unit 10 in this example; however, the controller 100 and the outdoor unit 10 may be separated.

The outdoor heat exchangers 11 and 12 are, for example, fin tube type outdoor heat exchangers. Furthermore, an outdoor fan 16 is disposed to be opposed to the outdoor heat exchanger 11. For example, the outdoor fan 16 is an axial flow fan. The compressor 13 can change drive frequency by a publically-known inverter control. A suction cup 17, which is a relatively small gas/liquid separator, is provided with an intake port 13*a* of the compressor 13. Publically-known structures are used for the four-way valve 14 and the accumulator 15.

The outdoor unit 10 and the indoor units 21, 22, and 23 are connected through the pipes 31, 32, 33, and 34. Specifically, one end of each of the outdoor heat exchangers 11 and 12 are connected to the pipe 31, one end of each of the indoor units 21, 22, and 23 is connected to the pipe 32, and the pipes 31 and 32 are connected together through a valve V11. Furthermore, the other end of each of the outdoor heat exchangers 11 and 12 is connected to the pipe 33, the other end of each of the indoor units 21, 22, and 23 is connected to the pipe 34, and the pipes 33 and 34 are connected together through a valve 12. A refrigerant as a medium flows through the pipes 31, 32, 33, and 34. Note that, the compressor 13, four-way valve 14, accumulator 15, and suction cup 17 are provided with the passage of the pipe 33.

The air conditioner 1 with the aforementioned structure can perform heating or cooling to adjust a temperature of a space where the indoor units 21, 22, and 23 are arranged to a target temperature.

Furthermore, in the outdoor unit 10, an expansion valve V1 is disposed between the outdoor heat exchanger 11 and the pipe 31, and an expansion valve V2 is disposed between the outdoor heat exchanger 12 and the pipe 31. The expansion valves V1 and V2 adjust a flow rate of the refrigerant (medium) flowing from the outdoor heat exchangers 11 and 12 to the pipes. An opening degree of each of the expansion valves V1 and V2 is determined based on commands from the controller 100. That is, the controller 100 is configured to adjust the expansion valves V1 and V2.

Furthermore, a temperature sensor T1 is provided with the outdoor heat exchanger 11 for detecting a temperature of the outdoor heat exchanger 11. Furthermore, a temperature sensor T2 is provided with the outdoor heat exchanger 12 for detecting a temperature of the outdoor heat exchanger 12. The temperature sensors T1 and T2 are disposed between the outdoor heat exchanges 11 and 12 and the expansion valves V1 and V2, respectively, in the passage of the refrigerant flowing from the outdoor heat exchangers 11 and 12 to the pipe 31. The temperatures detected are transmitted to the controller 100.

The controller 100 includes a calculation circuit, a memory, and the like, which are not shown. The memory stores a control program, and various data. The controller 100 executes the control program stored in the memory to perform a defrosting drive of the outdoor heat exchangers 11 and 12 in the heating drive. In the present embodiment, at a time when switching the four-way valve 14, first defrost means and second defrost means are executed as the defrosting drive in the heating drive.

The first defrost means is a means used for defrosting the outdoor heat exchangers 11 and 12 at the same time. The second defrost means is a means used for defrosting the outdoor heat exchanger 12 in advance, and defrosting the outdoor heat exchanger 11 after the start of defrosting of the outdoor heat exchanger 12.

Specifically, the second defrost means is started once in a few operations of the first defrost means which defrosts the outdoor heat exchangers 11 and 12 when the four-way valve 14 is switched according to the defrost control in the heating drive of the air conditioner 1, and the second defrost means narrows the opening degree of the expansion valve V1 between 0 and 50% of the fully opening degree, and sets the opening degree of the expansion valve V2 between 50 and 100% of the fully opening degree in order to end the defrosting of the outdoor heat exchanger 12, and then, while maintaining the opening degree of the expansion valve V2, sets the opening degree of the expansion valve V1 between 50 and 100% of the fully opening degree in order to perform defrosting of the outdoor heat exchanger 11. Thus, drain water of the outdoor heat exchanger 11 can be heated by the outdoor heat exchanger 12 after the defrosting, and thereby, an icicle growth can be suppressed.

Figure 2:
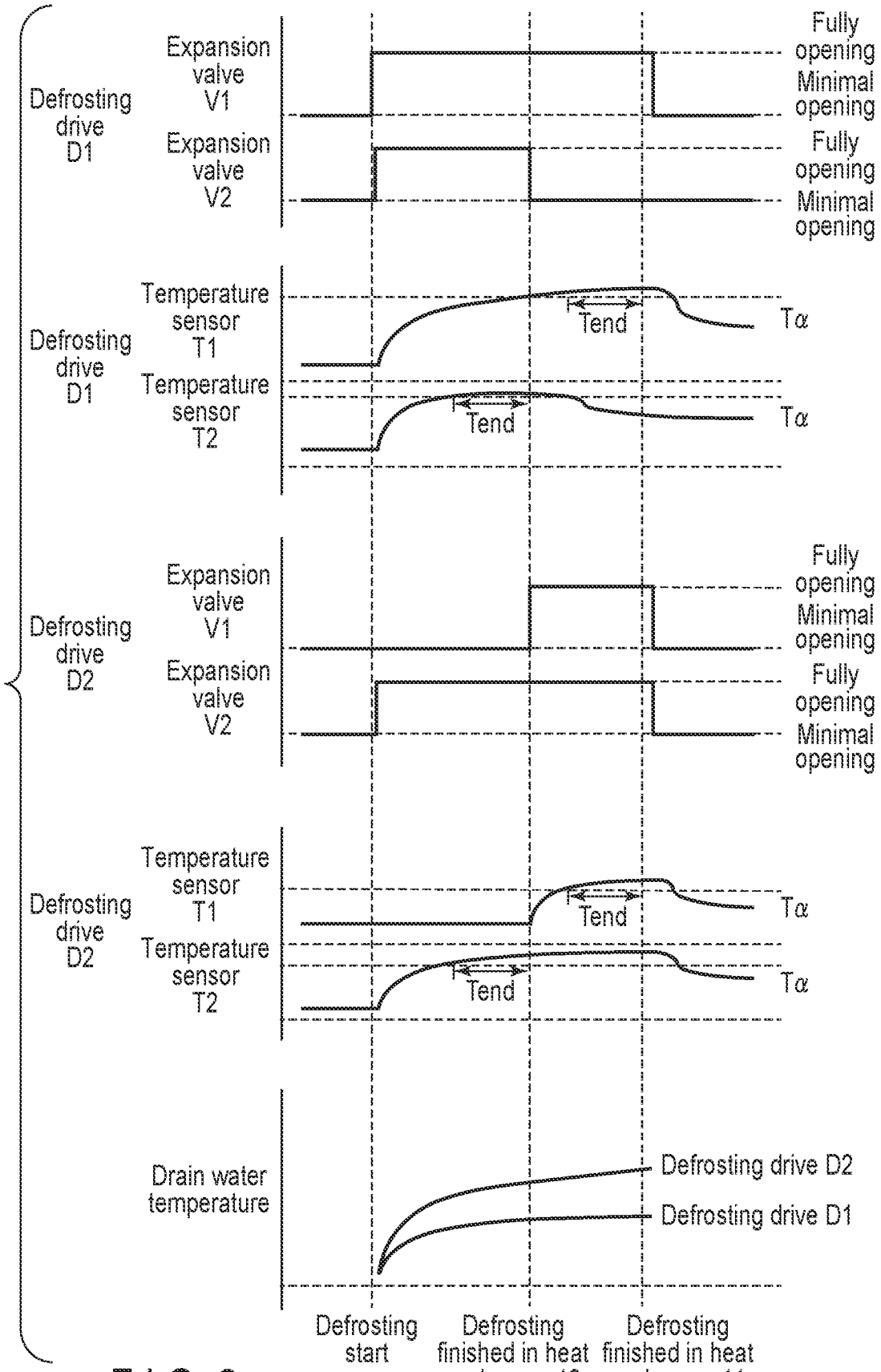
FIG. 2 is a timing chart illustrating a control of defrosting drive in a heating drive.

FIG. 2 is a timing chart illustrating the control of defrosting drive in the heating drive.

As in FIG. 2, in a defrosting drive D1 (first defrost means), when the defrosting is started, both the expansion valves V1 and V2 are fully opening, and thus, the temperatures detected by the temperature sensors T1 and T2 start to increase. If a defrosting end threshold is satisfied for a certain period in each of the outdoor heat exchangers 11 and 12, the defrosting drive ends, and each of the expansion valves V1 and V2 starts to close to a predetermined minimal opening degree.

In contrast, in a defrosting drive D2 (second defrost means), when the defrosting is started, only the expansion valve V2 is fully opened (and 0 to 20% in the expansion valve V1), and through the defrosting drive, the temperature of the temperature sensor T2 is increased. If the outdoor heat exchanger 12 satisfies the defrosting end threshold for a predetermined period and the defrosting of the outdoor heat exchanger 12 ends, the expansion valve V1 is fully opened, and the defrosting of the outdoor heat exchanger 11 is started, through the defrosting drive, the temperature of the temperature sensor T1 is increased. If the outdoor heat exchanger 11 satisfies the defrosting end threshold for a predetermined period and the defrosting of the outdoor heat exchanger 11 is finished, after all the defrosting is finished, the expansion valves V1 and V2 are closed to the predetermined minimal opening degree. The temperature of drain water is, as shown in the lower side of FIG. 2, higher in the defrosting drive D2 than the defrosting drive D1.

The air conditioner 1 structured as above can start defrosting of the outdoor heat exchanger 12 in advance and then perform defrosting of the outdoor heat exchanger 11 after the start of defrosting of the outdoor heat exchanger 12. Thus, the air conditioner 1 can heat the drain water of the outdoor heat exchanger 11 with the outdoor heat exchanger 12 after the defrosting such that growth of ice (icicle) is suppressed.

Furthermore, the air conditioner 1 adjusts the opening degrees of the expansion valves V1 and V2 in order to shift times to start the defrosting of the outdoor heat exchangers 11 and 12. Thus, the air conditioner 1 can suppress the growth of icicle cost effectively for not using additional actuator or circuit.

Furthermore, the air conditioner 1 may include an outside air temperature sensor configured to detect an outside air temperature in order to switch between the first defrost means and the second defrost means according to the temperature detected by the outside air temperature sensor. For example, if the outside air temperature is a temperature by which ice (icicle) does not grow, the controller 100 can use only the first defrost means for defrosting the outdoor heat exchangers 11 and 12 at the same time in order to shorten the defrosting time in the air conditioner 1.

Second Embodiment

In the aforementioned second defrost means, the outdoor heat exchanger 12 in the lower row is first defrosted such that draining is performable while a condensation temperature and an outdoor heat exchanger temperature in the defrosting drive are high, and furthermore, the outdoor heat exchanger 11 in the upper row is then defrosted while the temperature of the outdoor heat exchanger 12 in the lower row is increased, and thus, the drain temperature is increased such that the icicle growth can be suppressed. However, when the expansion valve V1 in the outdoor heat exchanger 11 before the defrosting, or the expansion valve V2 of the outdoor heat exchanger 12 is closed, the refrigerant resides in the outdoor heat exchanger 11 and 12, density inside the pipe 33 may be lowered, and low circulation of refrigerant may possibly occur. In the second embodiment, the air conditioner 1 which can avoid such a case will be explained. Note that, the same elements as in the first embodiment will be referred to by the same reference numbers, and the detailed explanation thereof will be omitted.

Figure 3:
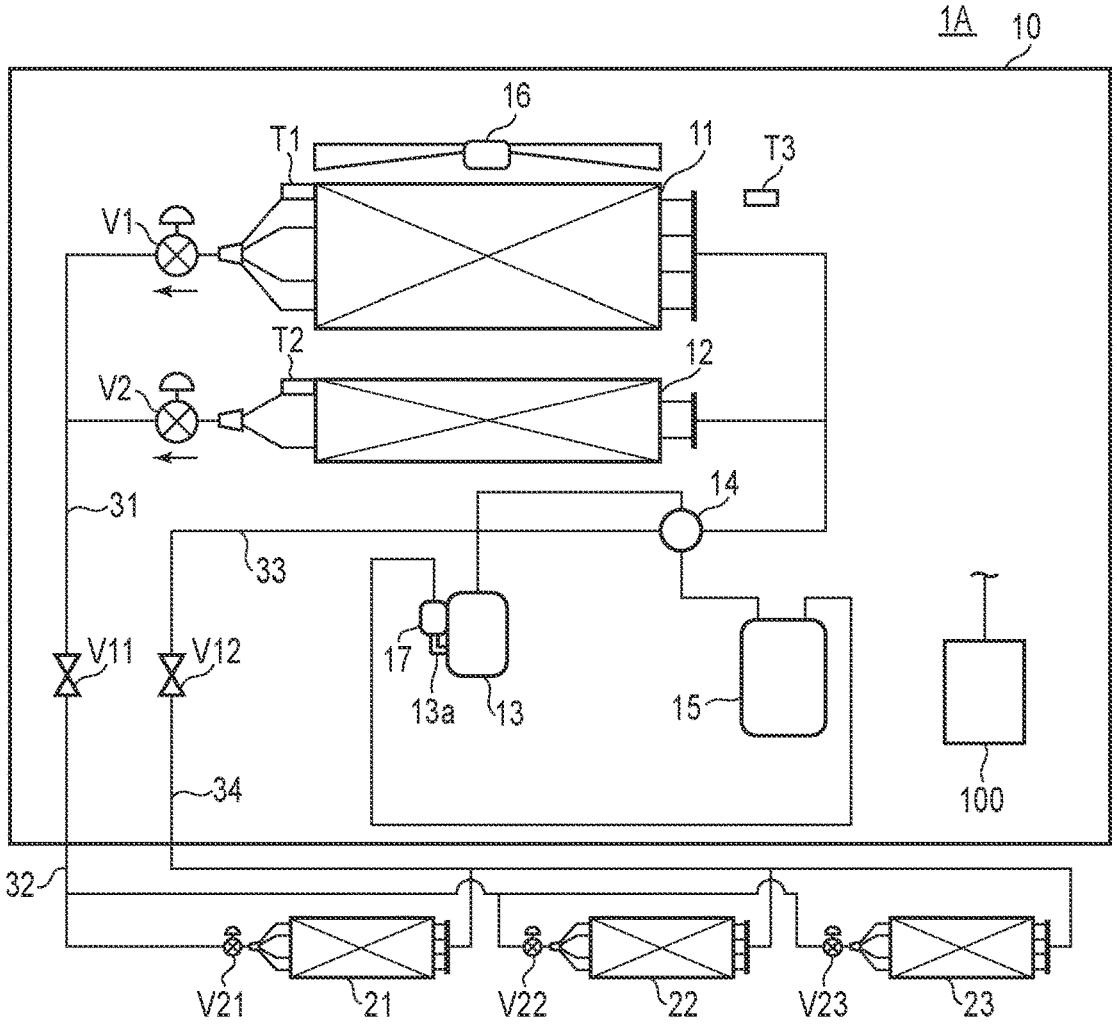
FIG. 3 is a diagram illustrating an example of the structure of an air conditioner.

FIG. 3 is a diagram illustrating an example of the structure of an air conditioner 1A.

A difference from the air conditioner 1 of the aforementioned first embodiment is an outside air temperature sensor T3 configured to detect a temperature of an outside air. The temperature of the outside air temperature sensor T3 is transmitted to the controller 100. Thus, the controller 100 is configured to detect the outside air temperature.

Next, a defrosting control executed by the controller 100 will be explained.

The controller 100 controls expansion valves V1 and V2 to open at a predetermined opening degree such that a minimal amount of refrigerant flows to the outdoor heat exchanger 11 before defrosting or the outdoor heat exchanger 12 before defrosting instead of closing the opening degree of the expansion valve V1 of the outdoor heat exchanger 11 before defrosting when the outdoor heat exchanger 12 is defrosted, or closing the opening degree of the expansion valve V2 disposed in the outdoor heat exchanger 12 before defrosting when the outdoor heat exchanger 11 is defrosted. Thus, the air conditioner 1 can avoid a decrease in rotation of the compressor 13 because of lowered pipe pressure or lowered suction pressure of compressor 13, and can suppress a decrease in drain water temperature in the defrosting drive.

Furthermore, in the aforementioned defrosting control, the controller 100 sets the opening degree of the expansion valve V1 of the outdoor heat exchanger 11 before defrosting, or the opening degree of the expansion valve V2 of the outdoor heat exchanger 11 before defrosting to a predetermined opening degree; however, different refrigerant amounts reside in the outdoor heat exchangers 11 and 12 during the defrosting based on the outside air temperature. Thus, in the defrosting drive, the controller 100 executes a control to switch between predetermined opening degrees of the expansion valves V1 and V2 based on the temperature detected by the outside air temperature sensor T3.

Figure 4:
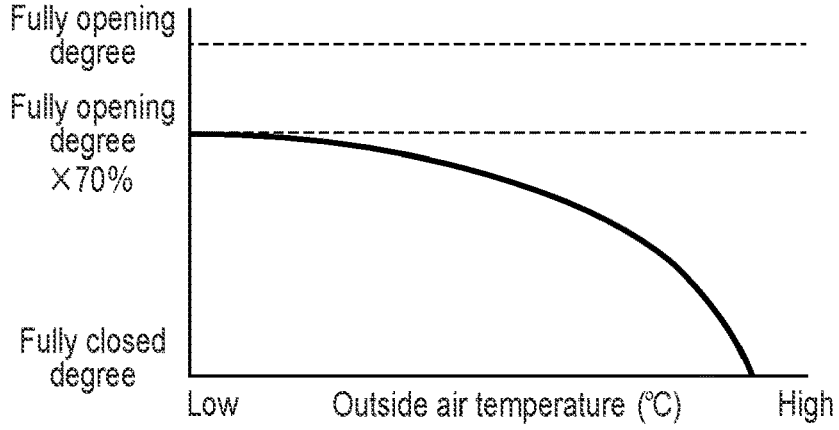
FIG. 4 illustrates an example of a relationship between a temperature detected by an outside air temperature sensor and an opening degree of an expansion valve.

FIG. 4 illustrates an example of a relationship between a temperature (outside air temperature) detected by the outside air temperature sensor T3 and opening degrees of the expansion valves V1 and V2. As in FIG. 4, the opening degrees of the expansion valves V1 and V2 are set to a predetermined degree which is below the fully opening degree such as 70% of fully opening degree at maximum and decreasing as the outside air temperature increases. That is, the controller 100 controls the opening degree of the expansion valve V1 of the outdoor heat exchanger 11 before defrosting or the expansion valve V2 of the outdoor heat exchanger 12 before defrosting to a predetermined opening degree based on the temperature detected by the outside air temperature sensor T3.

Figure 5:
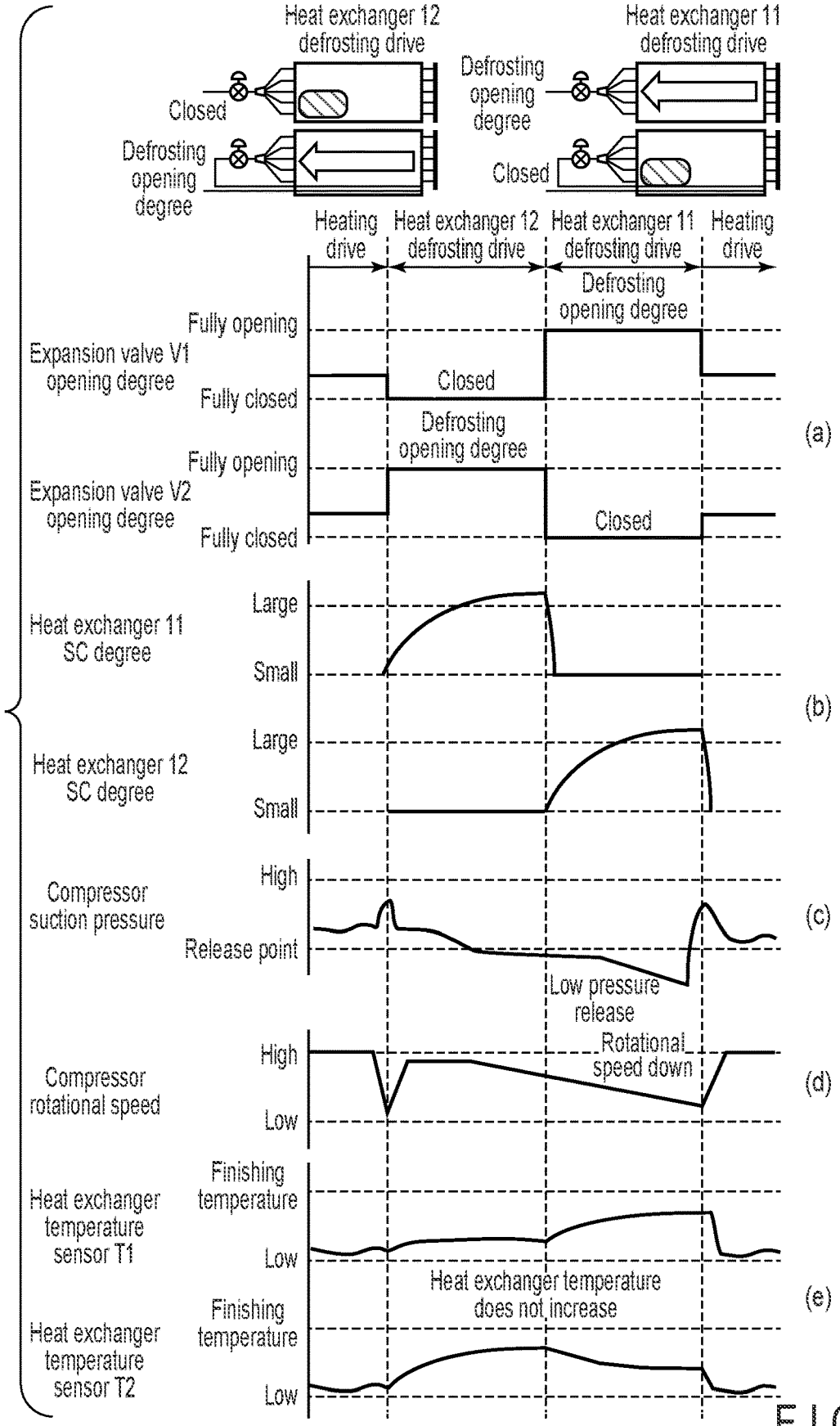
FIG. 5 is a diagram illustrating an example where an expansion valve of an outdoor heat exchanger before defrosting is closed.
Figure 6:
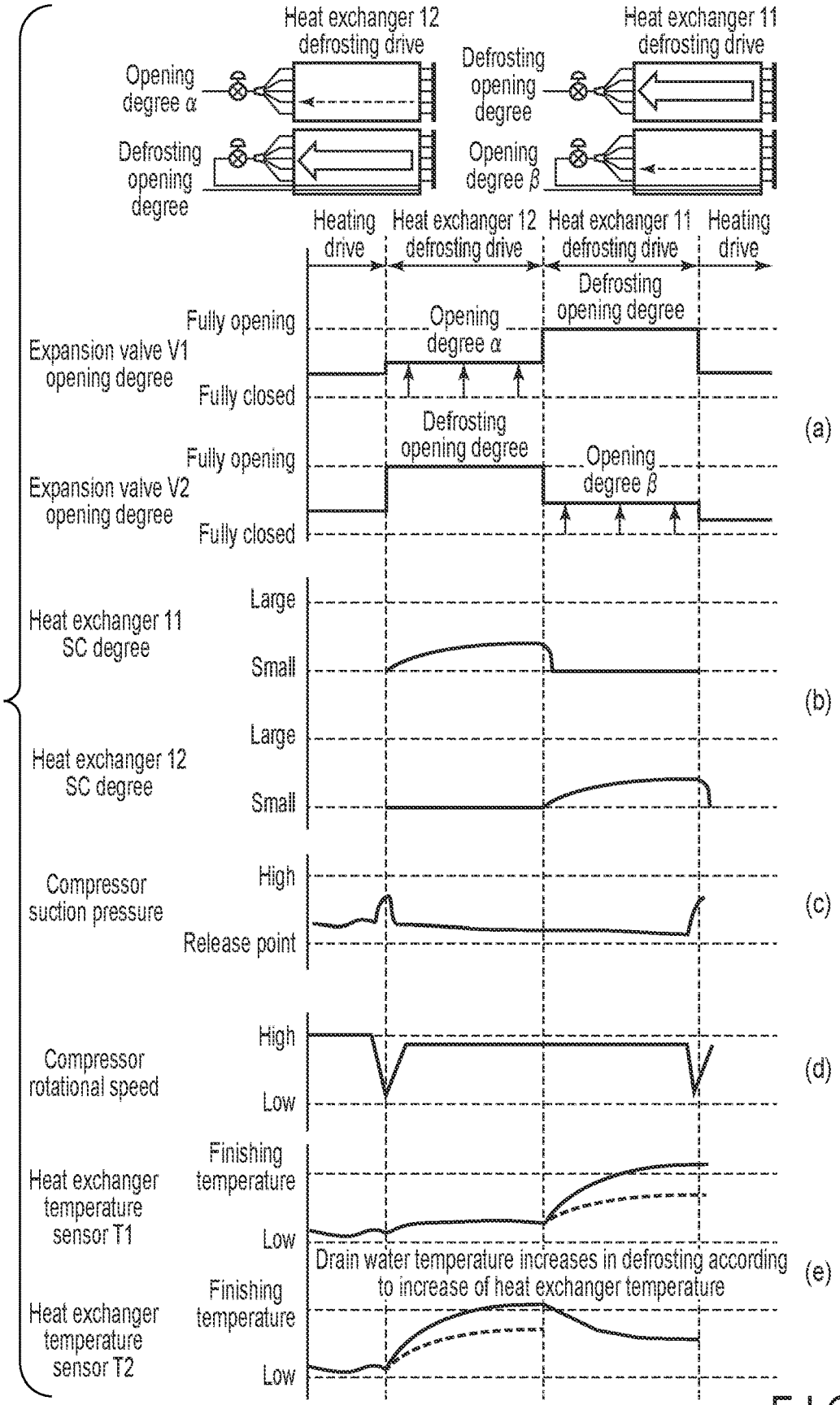
FIG. 6 is a diagram illustrating an example where the expansion valve of the outdoor heat exchanger before defrosting is opened.

Now, an effect of the air conditioner 1A will be explained with reference to FIGS. 5 and 6. FIG. 5 is a diagram illustrating an example where an expansion valve of an outdoor heat exchanger before defrosting is closed, and FIG. 6 is a diagram illustrating an example where an expansion valve of an outdoor heat exchanger before defrosting is opened.

First, an example of FIG. 5 will be explained. FIG. 5 illustrates a flow of the defrosting drive (second defrost means) in which a heating drive, defrosting drive of the outdoor heat exchanger 12, defrosting drive of the outdoor heat exchanger 11, and then heating drive are performed. In such a case, as in FIG. 5(*a*), when the outdoor heat exchanger 12 performs the defrosting drive, the opening degree of the expansion valve V2 becomes full, and the expansion valve V1 is closed. Then, when the outdoor heat exchanger 11 performs the defrosting drive, the opening degree of the expansion valve V1 becomes full, and the expansion valve V2 is closed. Correspondingly, as in FIG. 5(*b*), when the outdoor heat exchanger 12 performs the defrosting drive, a supercooling (SC) degree of the outdoor heat exchanger 11 increases, and then decreases in accordance with the stop of the defrosting drive. Then, when the outdoor heat exchanger 11 performs the defrosting drive, as in FIG. 5(*c*), the suction pressure of the compressor 13 decreases below a release point, and as in FIG. 5(*d*), the rotational speed of the compressor 13 decreases. Furthermore, in the defrosting drive, as in FIG. 5(*e*), the temperature sensors T1 and T2 do not show increase. As above, while the supercooling degree of the outdoor heat exchanger before defrosting increases, the temperature of the outdoor heat exchanger does not increase, and thus, ice (icicle) tends to grow.

Next, an example of FIG. 6 will be explained. FIG. 6 illustrates a flow of the defrosting drive (second defrost means) in which a heating drive, defrosting drive of the outdoor heat exchanger 12, defrosting drive of the outdoor heat exchanger 11, and then heating drive are performed, as in the flow of FIG. 5. As in FIG. 6(*a*), when the outdoor heat exchanger 12 performs the defrosting drive, the opening degree of the expansion valve V2 becomes full, and the opening degree of the expansion valve V1 is opening degree $\alpha$. Then, when the outdoor heat exchanger 11 performs the defrosting drive, the opening degree of the expansion valve V1 becomes full, and the opening degree of the expansion valve V2 is opening degree $\beta$. As above, the opening degree of the expansion valve of the outdoor heat exchanger before defrosting is slightly opened to allow the refrigerant flow. Correspondingly, as in FIG. 6(*b*), the SC degree of the outdoor heat exchanger before defrosting becomes smaller as compared to the example of FIG. 5(*b*). Furthermore, as in FIG. 6(*c*) and FIG. 6(*d*), a decrease in suction pressure of the compressor 13 and a decrease in the rotational speed thereof are better suppressed as compared to the examples of FIG. 5(*c*) and FIG. 5(*d*). Furthermore, in the defrosting drive time, as in FIG. 6(*e*), the temperature sensors T1 and T2 show increased values as compared to the example of FIG. 5(*e*). Note that, a dotted line of FIG. 6(*e*) indicates a temperature graph of FIG. 5(*e*).

As can be understood from the above, the air conditioner 1 can optimize the opening degree of the expansion valve V1 of the outdoor heat exchanger 11 before defrosting or the opening degree of the expansion valve V2 of the outdoor heat exchanger 12 before defrosting based on the temperature detected by the outside air temperature sensor T3 or the drive condition. Thus, the air conditioner 1 can suppress a decrease in the defrosting performance and a drain water temperature decrease.

Furthermore, even if the opening degree of the expansion valve V1 of the outdoor heat exchanger 11 before defrosting, or the opening degree of the expansion valve V2 of the outdoor heat exchanger 12 before defrosting are set based on the temperature detected by the outside air temperature sensor T3, the refrigerant may reside in the outdoor heat exchangers 11 and 12 in the defrosting, the suction pressure of the compressor 13 may be decreased, and the rotational speed of the compressor 13 may be lowered. Upon detection of such a drive condition, the controller 100 may increase the opening degrees of the expansion valves V1 and V2 from the predetermined opening degrees. Thus, the air conditioner 1A can further suppress the decrease in the defrosting performance caused by the lower refrigerant circulation and the drain water temperature decrease in the defrosting.

Third Embodiment

A case where a liquefied refrigerant resides in an outdoor heat exchanger in the defrosting drive even if the opening degrees of the expansion valves V1 and V2 are set based on the temperature detected by the outside air temperature sensor T3 may be possible. Thus, in the present embodiment, a refrigerant residue generated in the outdoor heat exchangers 11 and 12 in the defrosting is estimated, and a process dealing with the estimated refrigerant residue is added, and in this respect, it is different from the aforementioned second embodiment. Thus, the additional process will be explained here. Note that, the same elements as in the second embodiment will be referred to by the same reference numbers, and the detailed explanation thereof will be omitted.

Figure 7:
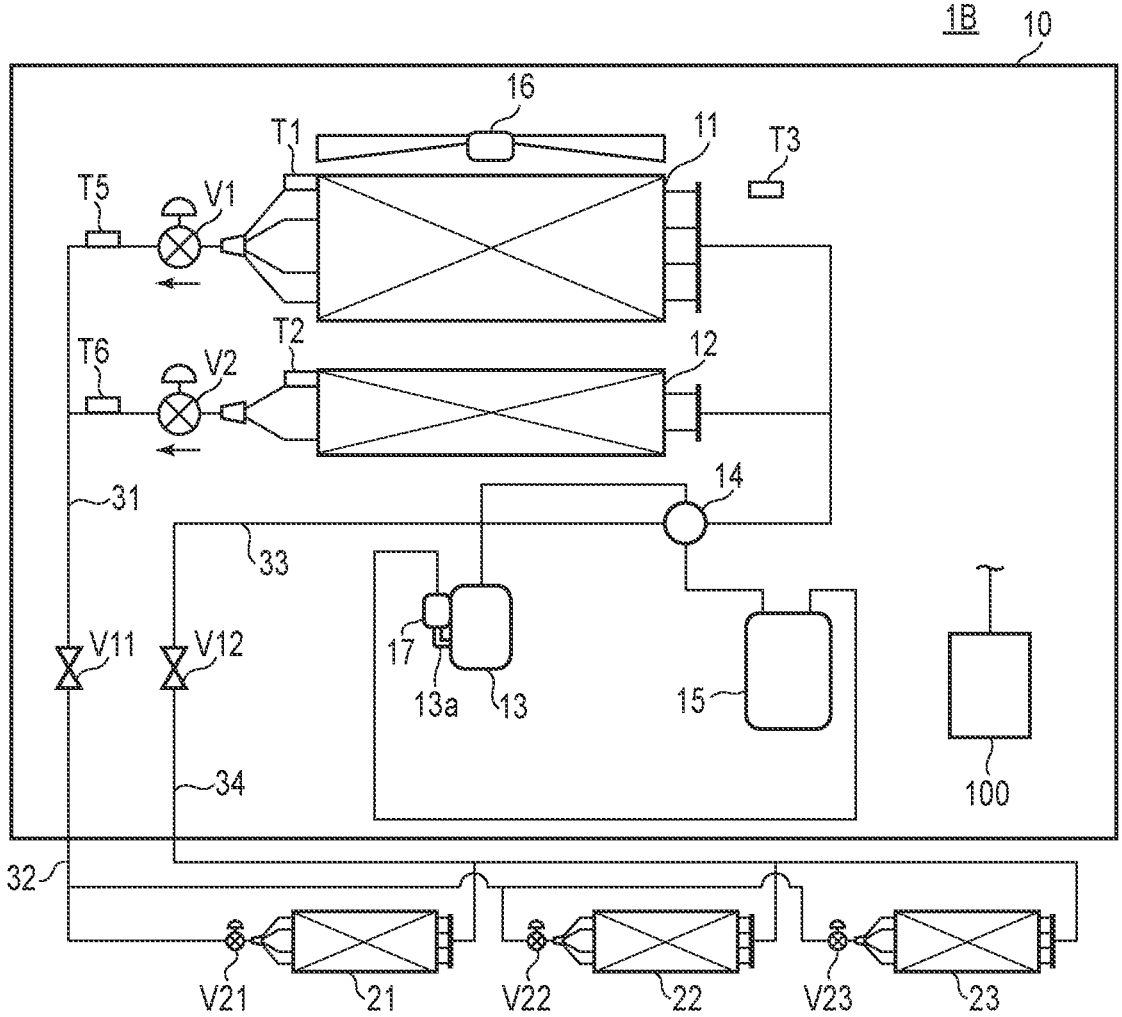
FIG. 7 illustrates an example of the structure of an air conditioner.

FIG. 7 is a diagram illustrating an example of the structure of an air conditioner 1B.

A difference from the air conditioner 1 of the aforementioned second embodiment is a pipe temperature sensor T5 configured to detect a temperature of the refrigerant flowing from the expansion valve V1 to the pipe 31, and a pipe temperature sensor T6 configured to detect a temperature of the refrigerant flowing from the expansion valve V2 to the pipe 31. The temperatures detected by the pipe temperature sensors T5 and T6 are transmitted to the controller 100. Thus, the controller 100 is configured to detect the temperatures of the refrigerant flowing from the expansion valves V1 and V2 to the pipe 31.

Figure 8:
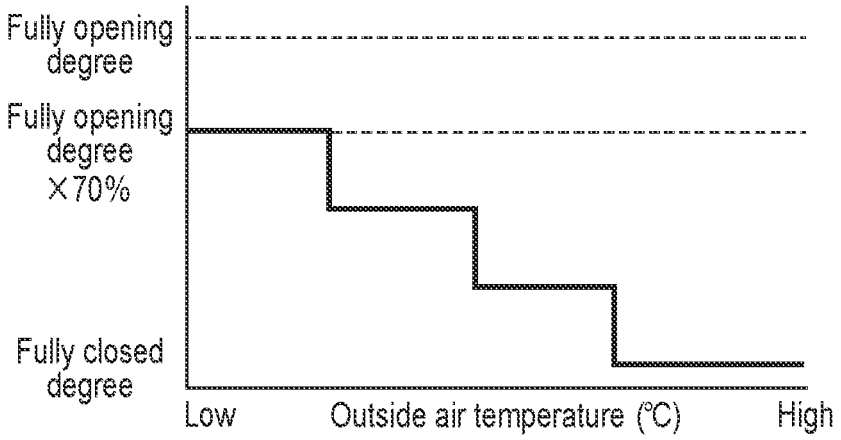
FIG. 8 illustrates an example of a relationship between a temperature detected by the outside air temperature sensor and an opening degree of the expansion valve.

FIG. 8 illustrates an example of a relationship between a temperature (outside air temperature) detected by the outside air temperature sensor T3 and opening degrees of the expansion valves V1 and V2. As in FIG. 8, the opening degrees of the expansion valves V1 and V2 are set to a predetermined degree which is below the fully opening degree such as 70% of fully opening degree at maximum and gradually decreasing as the outside air temperature increases. That is, the controller 100 controls the opening degree of the expansion valve V1 of the outdoor heat exchanger 11 before defrosting or the expansion valve V2 of the outdoor heat exchanger 12 before defrosting to a predetermined opening degree based on the temperature detected by the outside air temperature sensor T3. By the gradual control of the expansion valves V1 and V2, as compared to the linear control of FIG. 4, the controlling structure can be formed simply.

The controller 100 includes a first estimation means used for estimating a refrigerant residue amount of the outdoor heat exchanger 11 based on a temperature acquired by the temperature sensor T1 (first outdoor heat exchanger temperature sensor) and a temperature acquired by a pipe temperature sensor T5 (first refrigerant temperature sensor), and a second estimation means used for estimating a refrigerant residue amount of the outdoor heat exchanger 12 based on a temperature acquired by the temperature sensor T2 (second outdoor heat exchanger temperature sensor) and a temperature acquired by a pipe temperature sensor T6 (second refrigerant temperature sensor). Furthermore, the controller 100 adjusts the opening degree of the expansion valve V1 or the opening degree of the expansion valve V2 based on the refrigerant residue amounts estimated by the first estimation means and the second estimation means. As above, by estimating the refrigerant residue amounts in the outdoor heat exchangers, the opening degree of the expansion valve V1 or the expansion valve V2 disposed in the outdoor heat exchanger which is not subjected to the defrosting drive can be corrected.

Figure 9:
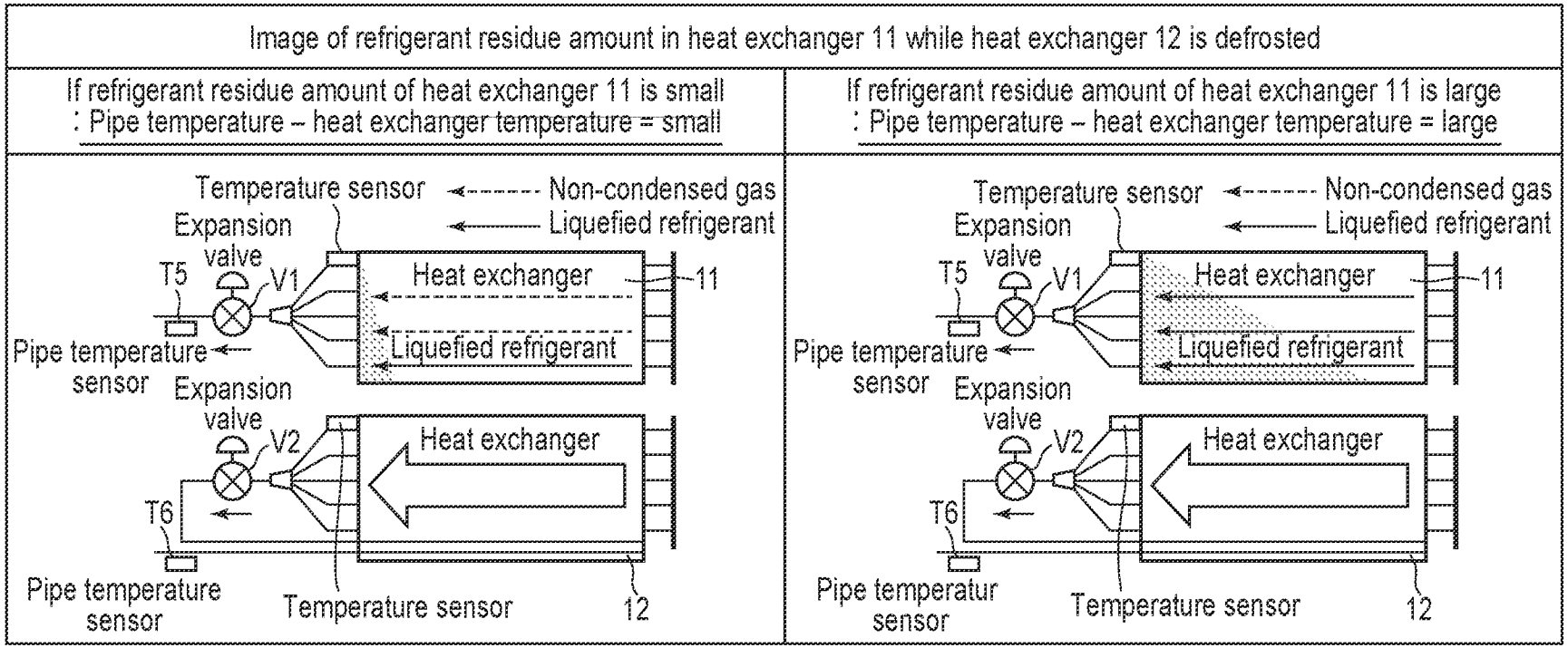
FIG. 9 is a diagram illustrating a refrigerant residue amount in the outdoor heat exchanger during the defrosting of the outdoor heat exchanger.

FIG. 9 is a diagram illustrating the refrigerant residue amount in the outdoor heat exchanger 11 while the outdoor heat exchanger 12 is being defrosted. As in the left side of FIG. 9, if the refrigerant residue amount of the outdoor heat exchanger 11 is small, pipe temperature−outdoor heat exchanger temperature=small. On the other hand, if the refrigerant residue amount of the outdoor heat exchanger 11 is large, pipe temperature−outdoor heat exchanger temperature=large. Thus, based on a temperature difference between the temperature sensor T1 and the pipe temperature sensor T5 and a temperature difference between the temperature sensor T2 and the pipe temperature sensor T6, the controller 100 can estimate the refrigerant residue amount as described above.

Figure 10:
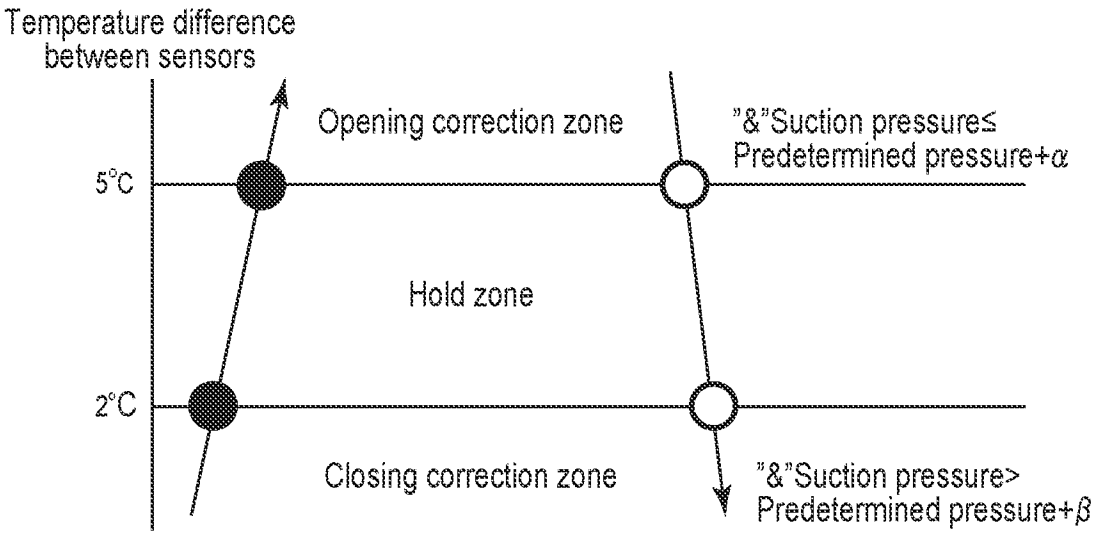
FIG. 10 is a diagram illustrating adjustment of the opening degree of the expansion valve according to the refrigerant residue amount.

FIG. 10 illustrates correction of opening degrees of expansion valves based on the refrigerant residue amount. The vertical axis represents a temperature difference between the temperature sensor T1 and the pipe temperature sensor T5, and a temperature difference between the temperature sensor T2 and the pipe temperature sensor T6, where the temperature differences are 5° C. and 2° C., respectively.

As in FIG. 10, while a large amount of refrigerant resides in the outdoor heat exchanger before defrosting, and the suction pressure of the compressor 13 indicates a predetermined pressure+α, for example, 1.5 kg/cm$^2$ (low pressure release control point of compressor rotational speed+0.3) or less, if a temperature difference between the temperature sensor T1 and the pipe temperature sensor T5 (or temperature difference between the temperature sensor T2 and the pipe temperature sensor T6) is 5° C. or more, the controller 100 corrects the opening degree of the expansion valve V1 or V2 in the opening direction until the temperature difference becomes below 5° C. Furthermore, while the suction pressure of the compressor 13 indicates a predetermined pressure+β, for example, above 1.5 kg/cm$^2$, if a temperature difference between the temperature sensor T1 and the pipe temperature sensor T5 (or temperature difference between the temperature sensor T2 and the pipe temperature sensor T6) is below 2° C., the controller 100 corrects the opening degree of the expansion valve V1 or V2 in the closing direction. Thus, the air conditioner 1 can avoid a low defrosting performance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioner in which an indoor unit and an outdoor unit are connected by a pipe, and a temperature of a space where the indoor unit is disposed is conditioned, the air conditioner comprising:

a controller configured to control the indoor unit and the outdoor unit, wherein the outdoor unit includes a first outdoor heat exchanger configured to exchange heat of a temperature of a refrigerant flowing from the pipe with an outside air, a second outdoor heat exchanger configured to exchange heat of the temperature of the refrigerant flowing from the pipe with the outside air, the second outdoor heat exchanger disposed below the first outdoor heat exchanger, a first expansion valve configured to adjust a flow rate of the refrigerant flowing from the first outdoor heat exchanger to the pipe, a second expansion valve configured to adjust a flow rate of the refrigerant flowing from the second outdoor heat exchanger to the pipe, an outside air temperature sensor configured to acquire a temperature of outside air, a first outdoor heat exchanger temperature sensor configured to acquire a temperature of the first outdoor heat exchanger, a first refrigerant temperature sensor configured to acquire a temperature of the refrigerant flowing from the first expansion valve to the pipe, a second outdoor heat exchanger temperature sensor configured to acquire a temperature of the second outdoor heat exchanger, and a second refrigerant temperature sensor configured to acquire a temperature of the refrigerant flowing from the second expansion valve to the pipe, and the controller varies an opening degree of the first expansion valve and an opening degree of the second expansion valve to be equal to or less than a predetermined opening degree based on the temperature acquired by the outside air temperature sensor and switches between a first defrosting drive to defrost the first outdoor heat exchanger and the second outdoor heat exchanger at the same time, and a second defrosting drive to defrost the first outdoor heat exchanger after the start of defrosting of the second outdoor heat exchanger;

estimates a refrigerant residue amount of the first outdoor heat exchanger based on the temperatures acquired by the first outdoor heat exchanger temperature sensor and the first refrigerant temperature sensor, and a refrigerant residue amount of the second outdoor heat exchanger based on the temperatures acquired by the second outdoor heat exchanger temperature sensor and the second refrigerant temperature sensor; and adjusts the opening degree of the first expansion valve configured to adjust the flow rate of the refrigerant flowing from the first outdoor heat exchanger before defrosting to the pipe and the opening degree of the second expansion valve configured to adjust the flow rate of the refrigerant flowing from the second outdoor heat exchanger before defrosting to the pipe, based on the refrigerant residue amount of the first outdoor heat exchanger and the refrigerant residue amount of the second outdoor heat exchanger.

2. The air conditioner of claim 1, wherein when the controller defrosts the first outdoor heat exchanger after the start of defrosting of the second outdoor heat exchanger, the controller sets the opening degree of the first expansion valve to be equal to or less than the predetermined opening degree which is below a fully opening degree and defrosts the second outdoor heat exchanger, and sets the opening degree of the second expansion valve to be equal to or less than the predetermined opening degree which is below the fully opening degree and defrosts the first outdoor heat exchanger.

3. The air conditioner of claim 1, wherein the controller varies, if the first outdoor heat exchanger and the second outdoor heat exchanger are not in a defrost condition, and the temperature acquired by the outside air temperature sensor satisfies a certain condition, the opening degrees of the first and second expansion valves to be equal to or less than a fully opening degree.

* * * * *